US006178782B1

(12) United States Patent
Takeda et al.

(10) Patent No.: US 6,178,782 B1
(45) Date of Patent: Jan. 30, 2001

(54) STITCH LOOP RETAINING METHOD BY USING A FLAT KNITTING MACHINE

(75) Inventors: Koji Takeda, Wakayama; Toru Ekawa, Kainan, both of (JP)

(73) Assignee: Shima Seiki Manufacturing Limited, Wakayama (JP)

( * ) Notice: Under 35 U.S.C. 154(b), the term of this patent shall be extended for 0 days.

(21) Appl. No.: 09/502,436

(22) Filed: Feb. 11, 2000

(30) Foreign Application Priority Data

Feb. 12, 1999 (JP) ..... 11-034447

(51) Int. Cl.[7] ..... D04B 7/04
(52) U.S. Cl. ..... 66/64; 66/60 R
(58) Field of Search ..... 66/60 R, 64, 68, 66/69, 70, 75.1, 76, 147, 148

(56) References Cited

U.S. PATENT DOCUMENTS 4,637,228 * 1/1987 Shima ..... 66/64
4,643,003 * 2/1987 Schmodde ..... 66/64
5,343,719 * 9/1994 Nakamori et al. ..... 66/64
5,367,892 * 11/1994 Shima et al. ..... 66/64
5,557,948 * 9/1996 Shima et al. ..... 66/64
6,047,569 * 4/2000 Shima ..... 66/64

FOREIGN PATENT DOCUMENTS 61-51060 11/1986 (JP) .

* cited by examiner

*Primary Examiner*—Danny Worrell
(74) *Attorney, Agent, or Firm*—Arent Fox Kintner Plotkin & Kahn, PLLC

(57) ABSTRACT

A method for knitting without retaining double or more stitches on a needle when a loop transferring is performed in the fabric knitting including a stitch narrowing knitting and the like. The method includes the steps that a stitch loop is rested on the tongue of the compound needle on the first bed; that the stitch loop retained by the knitting member on the second bed is guided to a position where it can be transferred to the compound needle on the first bed; that the hook of the needle proper is advanced into the stitch loop retained on the knitting member on the second bed positioned at the transferring position; that the knitting member on the second bed is retracted to allow the stitch loop retained thereon to be retained by the compound needle on the first bed; and that the compound needle on the first bed is retracted to knock over the stitch loop rested on the tongue of the slider of the compound needle on the first bed, whereby the stitch loop is retained on the stitch loop transferred to the compound needle on the first bed.

9 Claims, 11 Drawing Sheets

STITCH LOOP RETAINING METHOD BY USING A FLAT KNITTING MACHINE

FIELD OF THE INVENTION

The present invention relates to a stitch loop retaining method by using a flat knitting machine having needle beds mounting thereon compound needles each comprising a needle proper having a hook at a top end thereof and a slider having a tongue composed of two combined blades, the needle proper and the slider being each arranged to be individually movable forward and backward.

PRIOR ART

In Japanese patent application No. Hei 10(1998)-109675 (which corresponds to U.S. Pat. No. 5,937,673)(Title: "Compound needle of a flat knitting machine"), the applicant disclosed a compound needle comprising a needle proper having a hook at a top end thereof and a slider having a tongue composed of two combined blades, the needle proper and the slider being each arranged to be individually movable back and forth. With the compound needle of this type, the novel knitting that was not accomplished with a latch needle or a conventional compound needle can be accomplished by meticulously controlling the movement of the slider with respect to the movement of the needle proper. Also, in Japanese patent applications No. Hei 10(1998)-187892 (which corresponds to EP 0 890 667) (Title: "A stitch loop forming method and a flat knitting machine therefor") and No. Hei 10(1998)-111842 (which corresponds to EP 0 881 314)(Title: "A method for holding a stitch loop"), the applicant proposed a novel knitting technique by using this type of compound needle.

When a fabric is knitted with a flat knitting machine, a loop transferring is performed. The loop transferring is a technique used to reduce a knitting width of a knitted fabric or to knit a structure pattern such as a mesh pattern. The loop transferring is also used to join knitted fabrics knitted in confronting relation on front and back needle beds. For example, when a knitting width of knitted fabric is reduced, a stitch loop at the side end of the knitted fabric is transferred to the inside stitch loop to form double stitches and, thereby, the knitting width can be reduced by one wale. When this knitting is repeated for the subsequent stitch loops, the knitting width can be reduced stepwise. This double stitches produced by the transferring of stitch loops are also formed when knitting the meshes or joining knitted fabrics together.

The double stitches thus formed in the process of the loop transferring are formed when a stitch loop is transferred from a needle on the transferring end to a needle on the receiving end retaining a stitch loop, so that two stitch loops are retained on the hook of the needle on the receiving end. When the knitting operation is continued in the state of two stitch loops being retained on the hook of the needle, the knitting condition is worsened, as compared with the knitting operation in the state of only a single stitch loop being retained by the hook of the needle. This presents evidently, for example, when fine stitches of high stitch densities are formed or a bold yarn is used in knitting, which may become some factors in the influence over the knitted fabric, such as a thread breakage or a drop stitch, and the influence over the needles themselves, such as a rigidity problem of the slider in a fine gauge machine. In addition, for example when a stitch narrowing knitting is performed of a rib knitted fabric, there may cases where a three-ply stitch loop formed of three stitch loops is retained by the hook of a single needle in the process of loop transferring, which will then present a further worse knitting conditions.

SUMMARY OF THE INVENTION

In consideration of the drawbacks mentioned above, the present invention has been made. It is an object of the present invention to provide a method for knitting without retaining double or more stitches on a needle when a loop transferring is performed in the fabric knitting including a stitch narrowing knitting and the like.

The present invention provides a stitch loop retaining method by using a flat knitting machine having (i) at least one first bed mounting thereon arrays of compound needles, each having a needle proper with a hook at a top end thereof and a slider having a tongue comprising two combined blades and being so structured that the needle proper and the slider can be individually moved forward and backward, and (ii) at least one second needle bed mounting thereon arrays of knitting members capable to transfer and receive stitch loops to and from the compound needles, wherein when a stitch loop (66, 86, 98, 106) retained by the knitting member on the second bed is transferred to the compound needle on the first bed retaining a stitch loop (65, 85, 97, 105), the stitch loop (65, 85, 97, 105) retained by the compound needle on the first bed is knocked over from the needle, to retain it on the stitch loop (66, 86, 98, 106) transferred from the knitting member on the second bed to the compound needle on the first bed, the stitch loop retaining method comprising the steps:

(a) that the stitch loop (65, 85, 97, 105) is rested on the tongue of the slider of the compound needle on the first bed;

(b) that the knitting member on the second bed is operated to guide the stitch loop (66, 86, 98, 106) retained by the knitting member to a position where it can be transferred to and received from the confronting compound needle on the first bed;

(c) that with the compound needle on the first bed kept in the state in which the stitch loop (65, 85, 97, 105) is rested on the tongue of its slider, the hook of the needle proper is advanced into the stitch loop (66, 86, 98, 106) retained on the knitting member on the second bed confronting the compound needle and positioned at the transferring position;

(d) that the knitting member on the second bed is retracted to allow the stitch loop (66, 86, 98, 106) retained thereon to be retained by the hook of the compound needle on the first bed; and (e) that the needle proper and the slider of the compound needle on the first bed are retracted so that the stitch loop (65, 85, 97, 105) rested on the tongue of the slider of the compound needle on the first bed can be knocked over beyond an end of the tongue and the hook, whereby the stitch loop (65, 85, 97, 105) are retained on the stitch loop (66, 86, 98, 106) transferred to the compound needle on the first bed. This permits the double stitches to be formed by the compound needle without retaining two stitch loops on the compound needle. In other words, only the stitch loop received from the knitting member on the second bed is retained by the hook of the compound needle on the first bed and, as a result, the stitch loop held on the tongue of the slider is knocked over to form the double stitches by combination with the stitch loop of the previous course.

The stitch loop retaining method of the invention may be effected by using a flat knitting machine having the second bed mounting thereon arrays of similar compound needles to the compound needles arranged on the first bed. This produces the result that the stitch loop is directly transferred from the compound needle on one bed to the related compound needle on the other bed.

The stitch loop retaining method of the invention may be effected by using a flat knitting machine having the second bed mounting thereon arrays of transfer jacks. This produces the result that the stitch loop is transferred from the transfer jack to the related compound needle on the other bed.

The step (a) that the stitch loop is rested on the tongue of the slider of the compound needle on the first bed may comprise the step that after the needle proper and the slider of the compound needle retaining the stitch loop by its hook are advanced so that the stitch loop retained by the hook can be rested on the tongue of the slider, only the needle proper is retracted to allow the stitch loop to be rested on the tongue of the slider. This produces the result that the stitch loop is transferred from the hook of the needle proper onto the tongue of the slider within the same compound needle.

The step (a) that the stitch loop is rested on the tongue of the slider of the compound needle on the first bed may comprise the steps that the knitting member on the second bed retaining the stitch loop is guided to the position to transfer the stitch loop; and that after the needle proper and the slider of the confronting compound needle on the first bed are both advanced so that the hook and the tongue can be both allowed to go into the loop of the stitch loop retained by the knitting member on the second bed, the knitting member of the second bed is retracted to allow the stitch loop to be rested on the tongue of the compound needle on the first bed. This produces the result that the stitch loop retained by the compound needle or the transfer jack on the second bed is transferred onto the tongue of the slider of the compound needle on the second bed.

DETAILED DESCRIPTION OF THE PREFERRED EMBODIMENTS

In the following, the preferred embodiments of a stitch loop retaining method of the present invention will be described with reference to the accompanying drawings.

Embodiment 1

Figure 1:
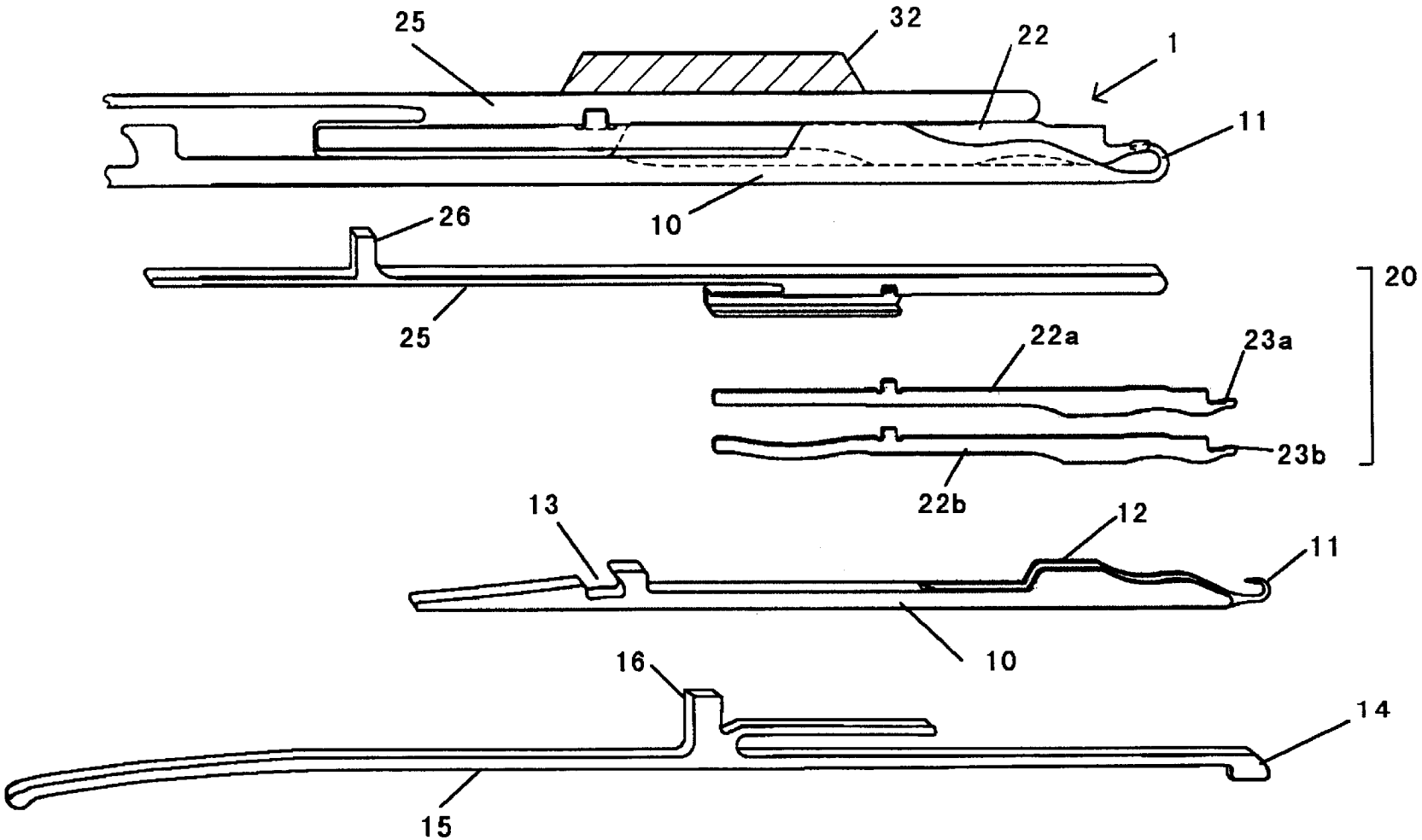
FIG. 1 is a diagram showing an example of a structure of a compound needle used in a stitch loop retaining method of the present invention.
Figure 2:
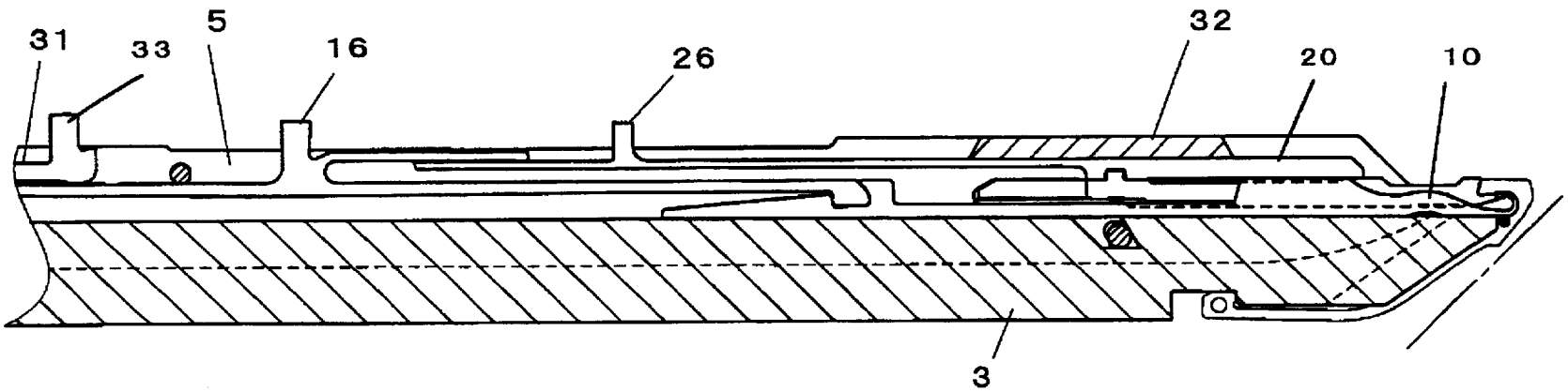
FIG. 2 is a longitudinal sectional view of a needle bed mounting a compound needle thereon.
Figure 3:
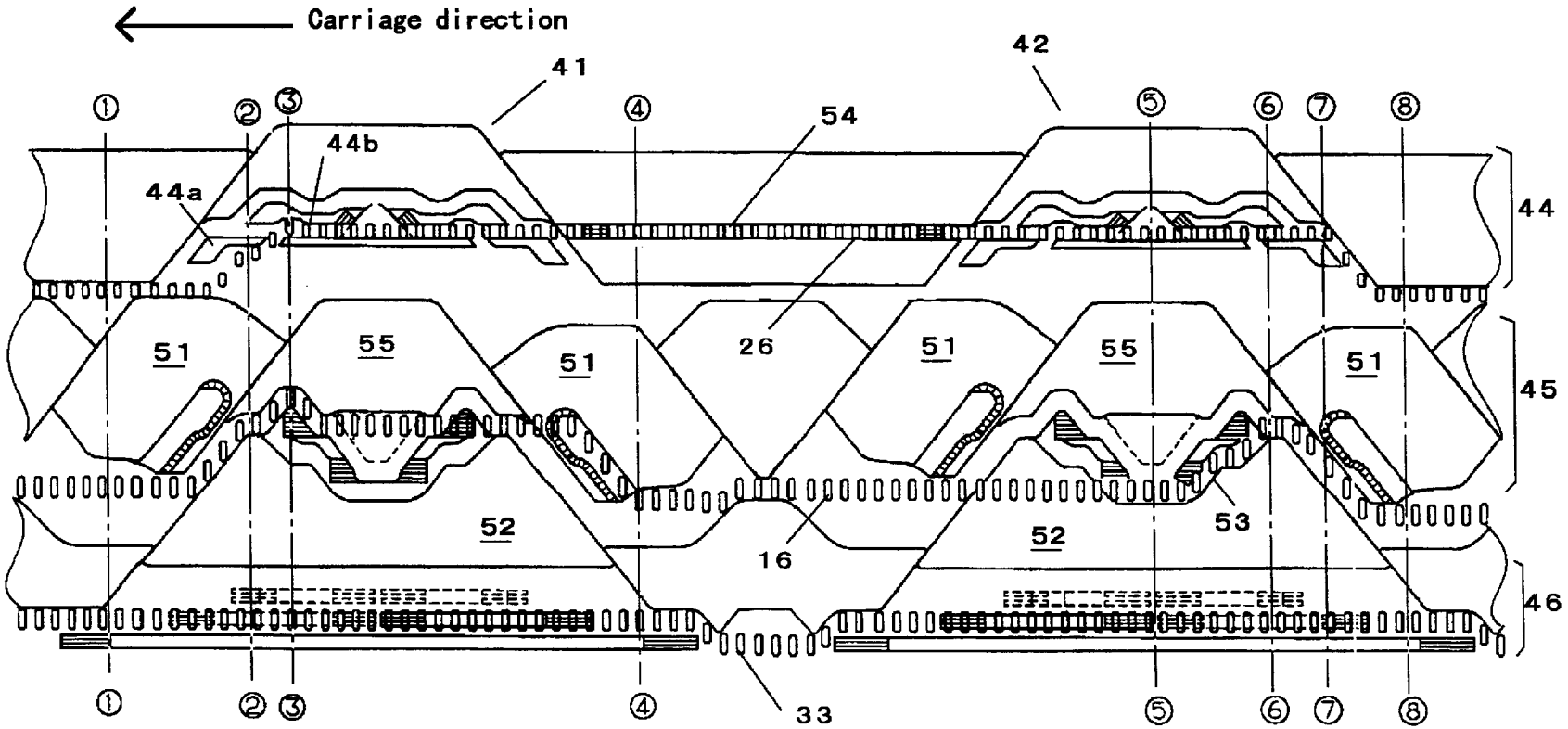
FIG. 3 is a showing of the tracks a butt of a needle proper and a butt of a slider of a needle o on a back needle bed follow when a knitting step 3 of Embodiment 1 is performed with knitting cam locks arranged on a bottom of a carriage.

FIG. 1 is a diagram showing a structure of a compound needle. FIG. 2 shows a longitudinal sectional view of a needle bed mounting a compound needle thereon. FIG. 3 shows cam locks used for knitting which are arranged on a bottom of a carriage.

In Embodiment 1, the so-called two-bed flat knitting machine in which a pair of needle beds are arranged in front and back is used. Each of the front and back needle beds of the flat knitting machine has arrays of needles each comprising a needle proper having a hook at a top end thereof and a slider with a tongue composed of two combined blades. The needle proper and the slider are provided with control butts, respectively, that are engageable with a needle control cam provided on a bottom surface of a carriage that moves over the needle beds reciprocally. The engagement of the needle control cam with the control butts of the needle proper and slider permits the slider and the needle proper to be individually movable forward and backward.

The needle proper 10 of the compound needle 1 has the hook 11 at an end portion thereof and a blade holding groove 12, provided behind the hook 11, for containing the slider 20 and supporting it to be movable forward and backward in the sliding direction of the needle proper 10. The slider 20 is formed by combining two blades 22*a*, 22*b* having an identical configuration and is contained in the blade holding groove 12 formed in the needle proper 10. The slider 20 has tongues 23*a*, 23*b* at the end thereof that are movable forward to a position beyond the hook 11 of the needle proper. 25 designates a slider body portion to which the blades 22 are fixed at the joint and is contained in a needle groove 5 provided in the needle bed 3. The slider body portion 25 has substantially the same thickness as the needle proper 10 and has at a rear side thereof a control butt 26 projecting from a surface of the needle bed. 15 designates a jack whose end 14 is fitted in a fitting portion 13 provided at a rear side of the needle proper, to be integrally combined with the needle proper. 16 designates a control butt provided at the jack. 32 designates a metal plate for holding the compound needle to prevent it from dropping off from the needle bed.

The carriage movable over the needle beds is provided with two, leading and trailing, knitting cam locks 41, 42. The cam locks form a complex cam system in which the cam locks can be brought into engagement with the control butts 16, 26 to permit a relative movement between the needle proper 10 and the slider 20 so that the degree of forward movement of the same with respect to the needle gap can be controlled to form a stitch loop of knit, tuck or miss and transfer and receive the stitch loop between the front and back needle beds. 44 designates a slider advancing-and-retracting cam for controlling the forward and backward movement of the butt of the slider. 45 designates a needle proper advancing-and-retracting cam for controlling the forward and backward movement of the butt of the needle proper. 46 designates a presser for selectively pressing a butt 33 projecting from an upper surface of a selector jack 31 arranged at a rear upper side of the jack 15. 51 designates a stitch cam. 52 designates a raising cam for the butt of the needle proper and 53 designates a receiving cam.

A bypass route 54 of the slider is arranged between the leading cam lock 41 and the trailing cam lock 42. With the leading cam lock 41, the needle proper 10 of the compound needle 1 holding a stitch loop on its hook 11 is advanced to a knit position and then is retracted without feeding any yarn thereto. When the needle proper 10 is retracted, the butt 26 of the slider 20 is made to pass through the bypass route 54 of the slider 20 in such a manner as to prevent a stitch loop from being knocked over from the end of the tongue 23 of the slider 20 and is guided to the next knitting cam lock, so as to permit the stitch loop retained by the hook 11 to be kept in its state of being rest (or held) on the tongue 23 of the slider 20. As the flat knitting machine having this bypass route 54 of the slider is disclosed in detail by the applicant's Japanese patent application No. Hei 9 (1998)-187892 (which corresponds to EP 0 890 667), the detailed description thereon will be omitted herein.

Figure 4:
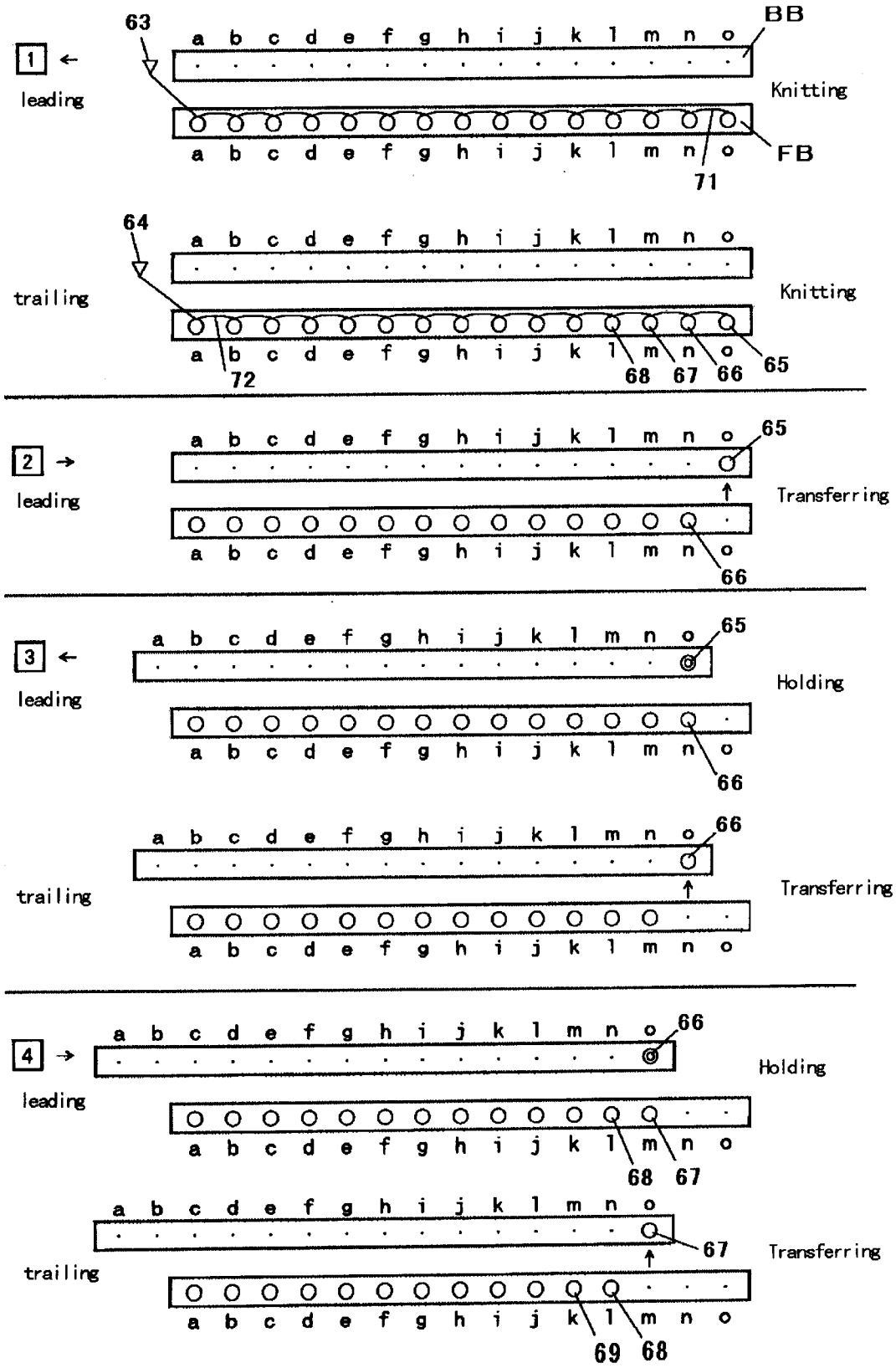
FIG. 4 shows diagrams showing knitting steps of a stitch loop retaining method according to Embodiment 1.

Referring to FIG. 4, there is shown a specific knitting effected by the stitch loop retaining method using the thus structured flat knitting machine. In illustration, FB designates a front bed and BB designates a back bed. Alphabets a–o designate needles mounted on the beds. Given in this embodiment is an example that a stitch loop 65 retained by the needle o located at the right-hand side of the knitted fabric knitted with the needles a–o on the front bed is transferred to and retained on a stitch loop 66 retained by an adjoining needle n.

First of all, in the step 1, stitch courses 71, 72 are formed by the leading and trailing cam locks 41, 42. 63, 64 designate yarn feeders. In the next step 2, the loop transferring is performed by the leading cam lock 41 so that the stitch loop 65 at the right end is transferred to the needle o on the back bed.

In the next step 3, after the back bed is racked leftward so that the stitch loop 65 can confront the stitch loop 66, the needle o on the back bed retaining the stitch loop 65 is actuated by the leading cam lock 41 to allow the butt 26 of the slider of the needle o to pass through the bypass route 54, so that the stitch loop 65 retained by the hook 11 can be rest on the tongue 23 of the slider 20 to be in the held state and is guided to the trailing cam lock 42. Then, the loop transferring is performed by the trailing cam lock 42 so that the stitch loop 66 retained by the needle n of the front bed can be transferred to the confronting needle o retaining the stitch loop 65 to retain the stitch loop 65 on the stitch loop 66.

Figure 5:
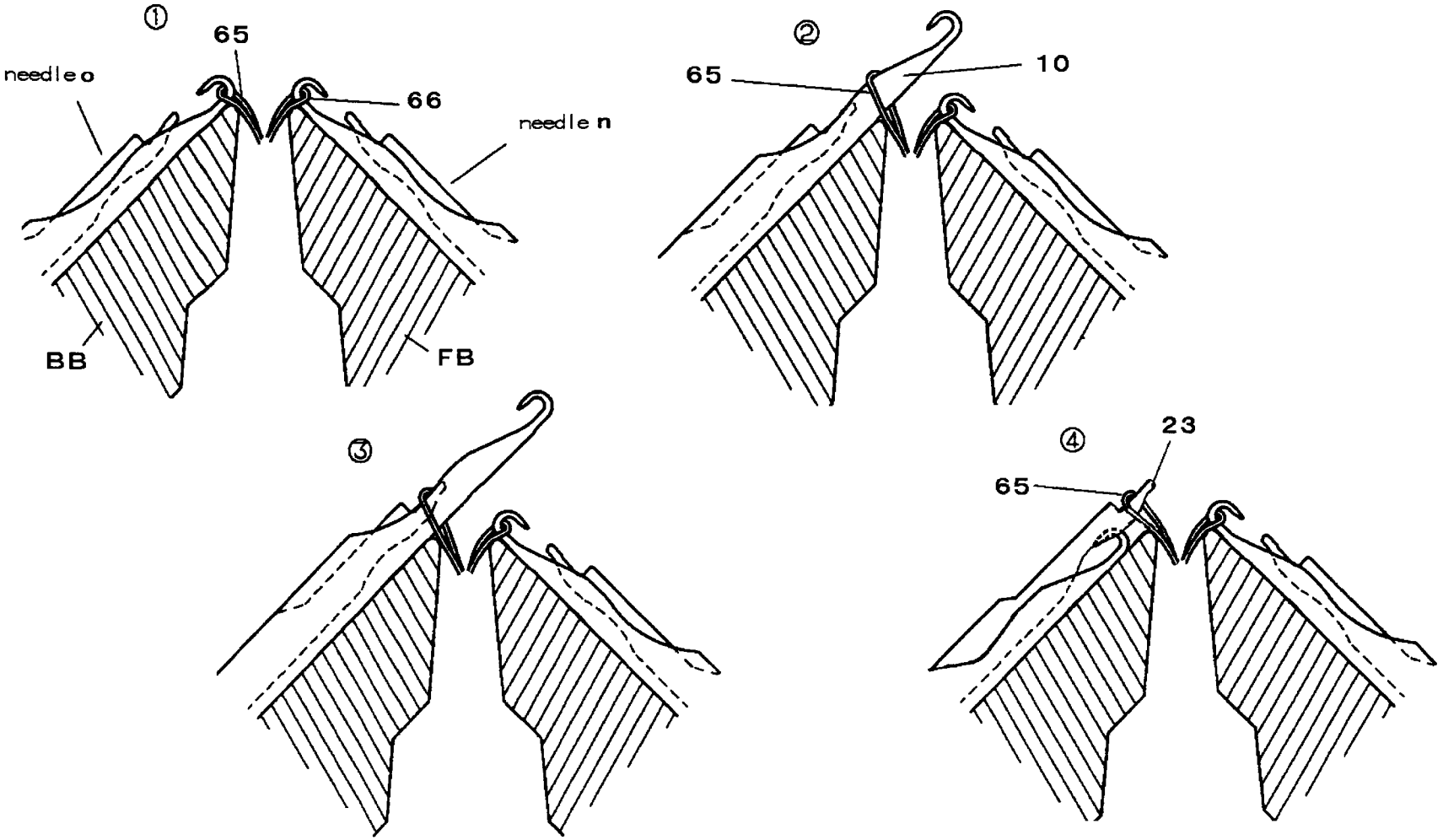
FIG. 5 shows diagrams showing movements of the needle o of the back needle bed in phases ① to ④ in FIG. 3.
Figure 6:
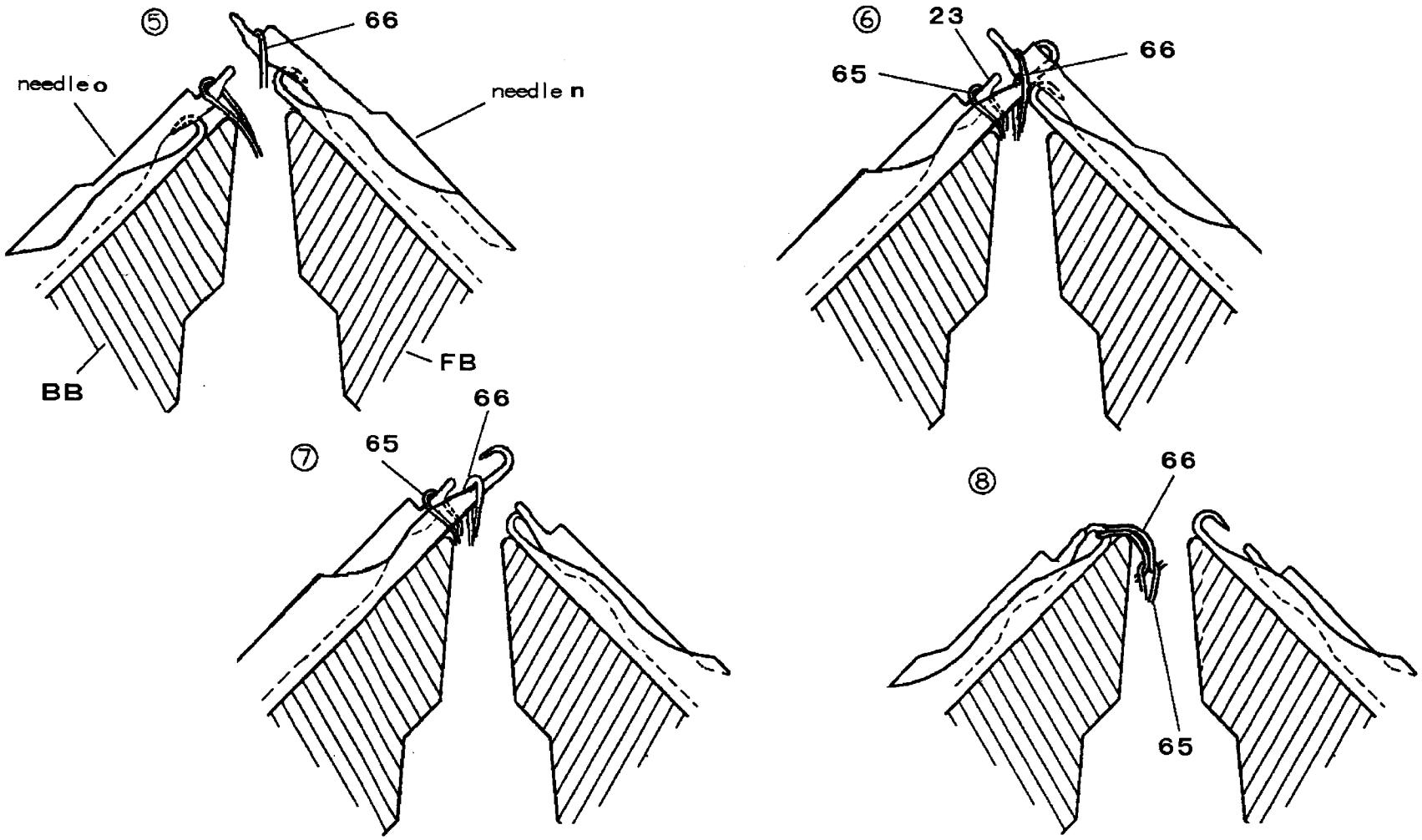
FIG. 6 shows diagrams showing movements of the needle o of the back needle bed in phases ⑤ to ⑧ in FIG. 3.

The details of the knitting by the step 3 will be described with reference to FIGS. 3, 4, 5 and 6. FIG. 3 shows the tracks for the butts 16, 26 provided at the needle proper 10 and the slider of the needle o on the back bed to pass along. FIGS. 5 and 6 show the motions of the needle n on the front bed and the needle o on the back bed in phases ① to ⑧ in FIG. 3, respectively.

First, the butt 26 of the jack is advanced from its initial position (phase ①, to a shoulder position along a cam face of the raising cam 52 and thereby the needle proper 10 and the slider 20 of the needle o on the back bed are advanced toward the needle gap (phase ②. In that position, the slider butt 26 is in abutment with a trailing edge of the lower slider guide cam 44*a*, so that the tongue 23 of the slider is absorbed in the blade holding groove 12 formed in the needle proper 10 and, as a result of this, the stitch loop 65 retained by the needle proper 10 is in the state of being positioned in front of it. Subsequently, the slider butt 26 is advanced further to the top along the cam face of the raising cam 52 (phase ③, during which the slider butt 26 is advanced to the position to contact with a middle slider guide cam 44*b*. In that position, the needle o is in the state of the slider tongue 23 running through the stitch loop 65 retained by the needle proper 10.

Then, after the jack butt 16 of the needle o passes the top of the raising cam 52, it is lowered down to the level of the shoulder by a bridge cam 55 and then is retracted to the initial position by the next stitch cam 51. On the other hand, the butt 26 of the slider 20 is made to pass through the bypass route 54 so that the stitch loop 65 retained by the hook 11 can be put into the holding state in which it is rested on the tongue 23 of the slider and, then, is guided to the next cam lock 42 (phase ④).

The needle n on the front bed retaining the stitch loop 66 is moved forward and backward by the trailing cam lock 42, to transfer the stitch loop 66 to the needle o on the back bed (the cam diagram is not shown). In the phase ⑤, the slider 20 is pushed up by a transfer cam (not shown), so that the needle n is advanced to a position for the stitch loop 66 to be transferred. During this operation, the needle o on the back bed maintains the holding state. In the phase ⑥, the needle o is acted upon by the receiving cam 53 and is advanced to the position for the stitch loop to be received, so as to allow the hook 11 to go into the stitch loop 66 located at the transferring position. Thus, in this state, the needle n retaining the stitch loop 66 is retracted, so that the stitch loop 66 is received by the hook of the needle o retaining the stitch loop 65 (phase ⑦). During this loop transferring operation, the stitch loop 65 is kept in its state of being held on the slider of the needle o.

Subsequently, the needle proper 10 of the needle o receiving the stitch loop 66 is acted upon by the stitch cam 51 and is retracted, and the relative movement between the needle proper 10 and the slider 20 permits the hook 11 to be closed. Then, the needle proper 10 and the slider 20 of the needle o are retracted together, so that the stitch loop 65 that was kept in the held state is knocked over beyond the hook 11 from above the tongue 23, so as to be retained on the stitch loop 66 (phase ⑧). The operations described above can permit the form of the double stitches without retaining two stitch loops on the needle.

Figure 7:
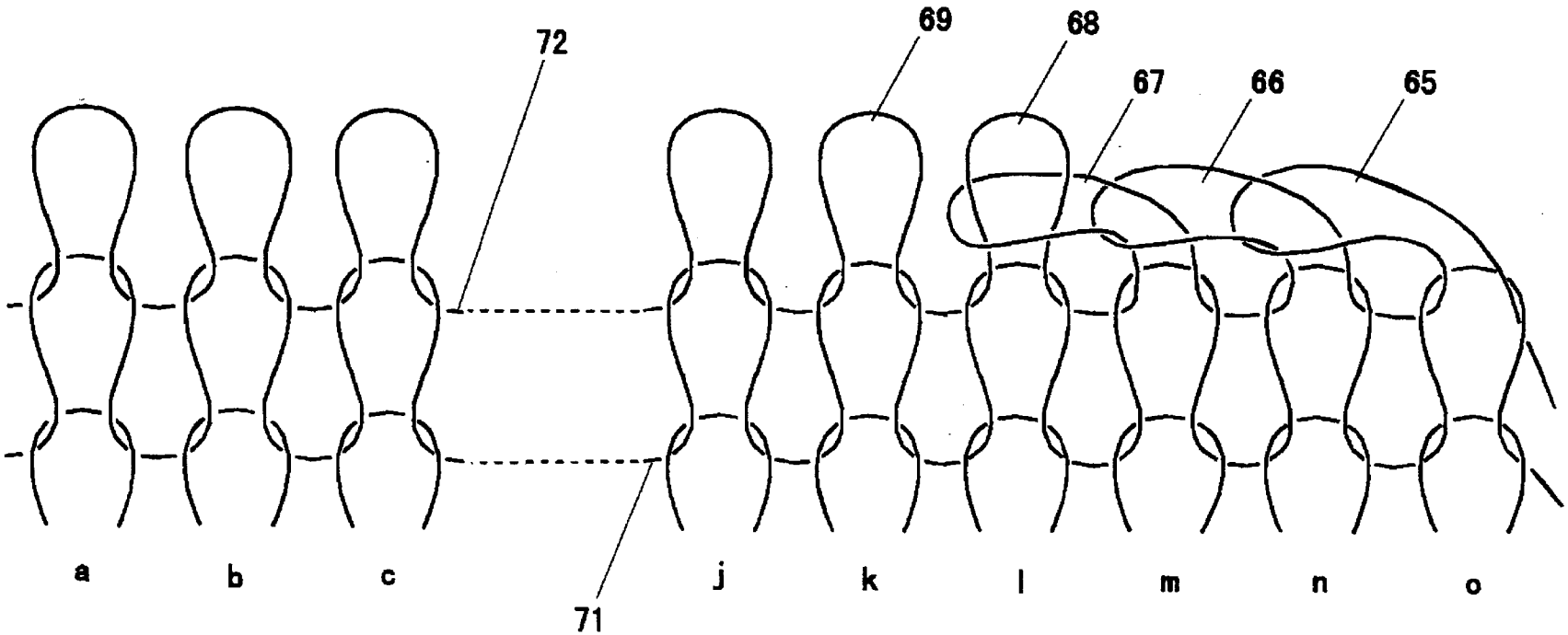
FIG. 7 is a diagram showing a loop structure of a knitted fabric formed by the knitting of Embodiment 1.

Next, in the step 4, the same process as in the step 3 is performed, so that the needle o is operated so that the stitch loop 66 can be held on the tongue 23 of the slider 20. Subsequently, the loop transferring is performed by the trailing cam lock 42 so that the stitch loop 67 retained by the needle m on the front bed can be transferred to the confronting needle o retaining the stitch loop 66 to retain the stitch loop 66 on the stitch loop 67. When this knitting is repeated for the subsequent stitch loops 68, 69, . . . , the stitch course 72 will be subject to the bind-off process in the order to the left, as shown in FIG. 7. If the racking of the back bed is found to be insufficient in quantity in the course of the knitting, then it may be racked back to try for the bind-off process again.

In the embodiment described above, there can be provided the advantage that the stitch loop retaining method of the invention can be effected by using two successive cam systems 41, 42 in addition to the provision of the bypass route of the slider in the carriage and making some minor modification to the knitting operation effected by the leading cam lock 41 and the loop transferring operation effected by the trailing cam lock 42. Likewise, this can be effected by a single cam system having only a single knitting cam lock. In this modification, the succeeding cam lock indicates a cam lock for the next course (or the same cam lock). The cam lock is provided at its both ends with bypass routes for the slider to be kept in its held state even after the carriage passes past it. The cam lock may be so structured that the butt of the slider can be guided into the cam lock when the carriage is guided there after reversed.

Embodiment 2

Next, another method for resting the stitch loop retained by the hook on the tongue of the slider will be described. In this method, when a stitch loop is transferred from needle to needle or is transferred from a transfer jack to the needle, the needle or transfer jack retaining the stitch loop is guided to the loop transferring position and then the needle proper and the slider of the needle on the confronting bed are advanced together so that the hook and the tongue can both be inserted into the stitch loop. Thereafter, the needle or transfer jack retaining the stitch loop is retracted so that the stitch loop can be held on the tongue of the compound needle. The details of this method are disclosed by the applicant's Japanese patent applications No. Hei 10(1998)-111842 (which corresponds to EP 0 881 314)(Title: "A method for holding a stitch loop") and No. Hei 10(1998)-132922 (Title: A stitch loop holding device of a flat knitting machine). In this method, the flat knitting machine attaching thereto a holding cam device and a transfer jack bed is used for holding a stitch loop.

Figure 8:
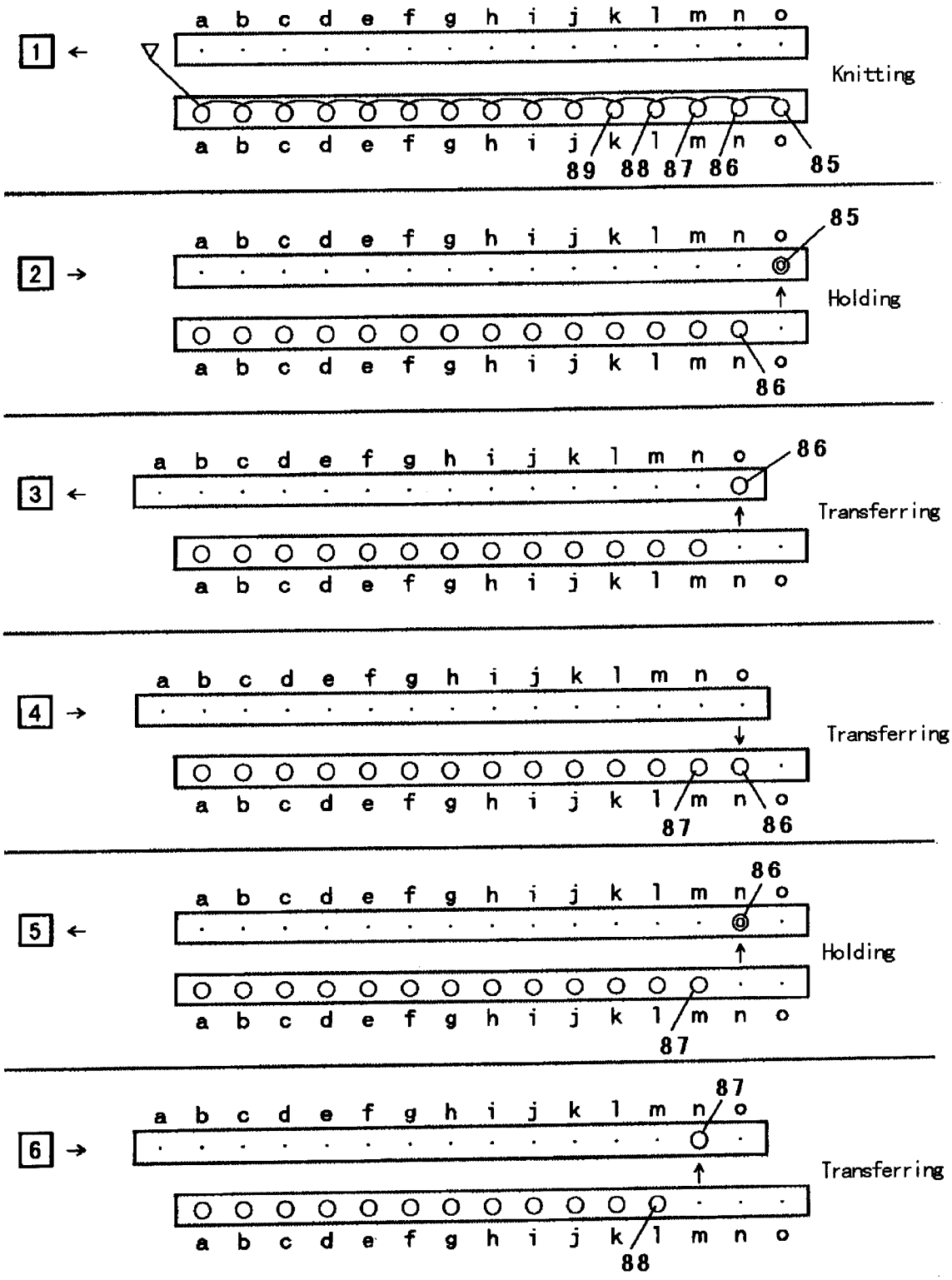
FIG. 8 shows diagrams showing knitting steps of a stitch loop retaining method according to Embodiment 2.

FIG. 8 shows the knitting effected by this method. Shown in the illustration is an example of the method using the single cam system in which the stitch loop is held directly onto the tongue of the slider of one needle from the other needle without using any transfer jack.

In the step 1, a stitch loop course is formed. In the step 2, a stitch loop 85 at the right end retained by the needle o on the front bed is held onto the tongue of the slider of the needle o on the back bed. In the next step 3, the back bed is racked leftward, with the stitch loop kept in this held state, so that the stitch loop 85 and the stitch loop 86 can confront each other to perform the loop transferring. The needle n retaining the stitch loop 86 is guided to the loop transferring position, so that the stitch loop is received by the confronting needle o retaining the stitch loop 85. This process is performed in the same manner as the process effected by the trailing cam lock in the step 3 of the embodiment 1. In the next step 4, the stitch loop 86 is transferred back to the original needle n on the front bed and then is held onto the tongue of the slider of the needle n on the back bed in the subsequent step 5. In the step 6, the back bed is racked leftward so that the stitch loop 86 and the stitch loop 87 can confront each other and, then, the stitch loop 87 is transferred to the confronting needle n retaining the stitch loop 86, so as to retain the stitch loop 86 on the stitch loop 87. This knitting is repeated for the following stitch loops 88, 89, . . . , to thereby produce the knitted fabric having the same knitting structure as the one provided by the knitting of the embodiment 1 shown in FIG. 7.

In the case where the transfer jack is used, after the stitch loop 85 is held onto a transfer jack (not shown) from the needle o on the front bed for a while, the stitch loop can be held onto the tongue of the slider of the needle o on the back bed from that transfer jack. This can provide an advantage of providing a simplified structure of the cam locks 41, 42 of the compound needle, as compared with the case where the stitch loop is directly retained from needle to needle.

Embodiment 3

Figure 9:
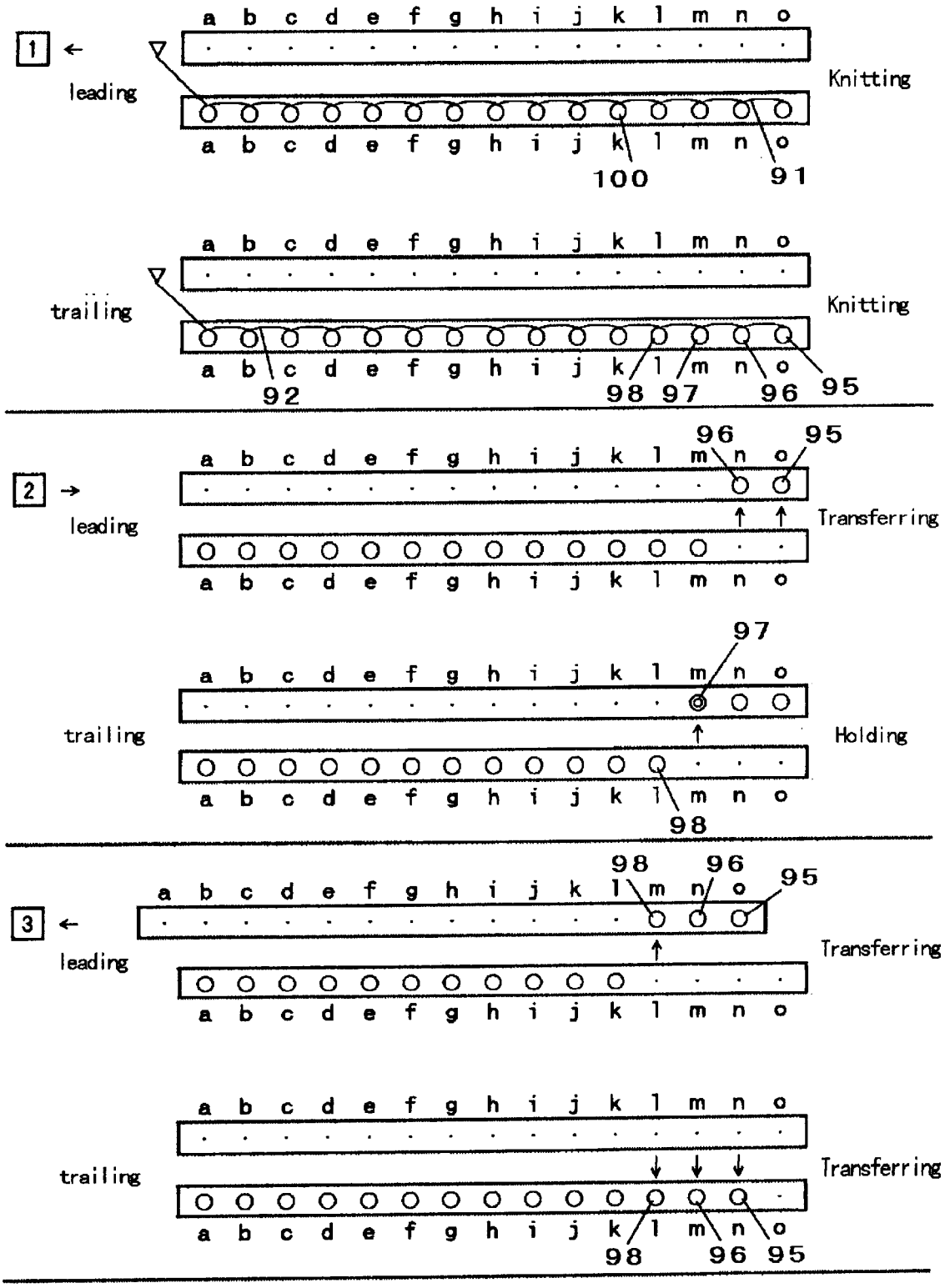
FIG. 9 shows diagrams showing knitting steps of an inside narrowing knitting according to Embodiment 3.
Figure 10:
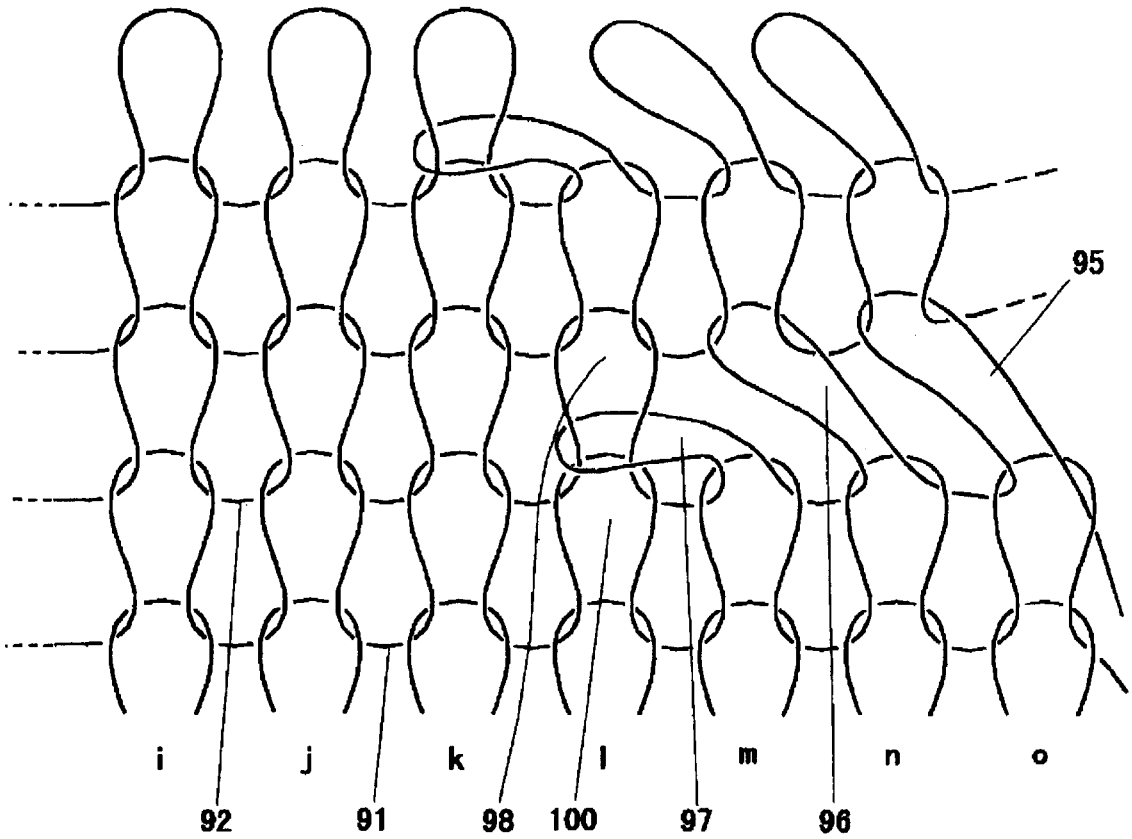
FIG. 10 is a diagram showing a loop structure of a knitted fabric formed by the knitting of Embodiment 3.

Next, the knitting of a knitted fabric making use of the stitch loop retaining method of the invention will be described. FIG. 9 shows knitting diagrams of an example of the method of the invention applied for an inside narrowing of a knitted fabric. FIG. 10 is a structural diagram of the loops. In this example, three stitch loops at a lateral end of the knitted fabric are moved toward the inside of the knitted fabric by one stitch each time when two courses are formed by a carriage having two cam locks.

First, in the step 1, a yarn is fed to the needles a–o on the front bed to form stitch loop courses 91, 92. Then, in the step 2, two stitch loops 95, 96 at the lateral end retained by the needles n, o on the front bed are transferred to the needles n, o on the back bed by the leading cam lock, and the stitch loop 97 in the third wale from the lateral side is held onto the tongue of the slider of the needle m on the back bed by the trailing cam lock.

In the step 3, the back bed is racked leftward by one stitch, and the stitch loop 98 retained by the needle 1 on the front bed is transferred to the needle m on the back bed holding the stitch loop 97 on its tongue by the leading cam lock, so that the stitch loop 97 is retained on the stitch loop 98 to form double stitches by combination with a stitch loop 100 of the previous course retained on the stitch loop 98. Then, the stitch loops 98, 96, 95 retained by the needles 1, m, n on the back needle are transferred back to the needles 1, m, n on the front bed by the trailing cam lock to complete one process. The knitting is repeated in the same manner as the steps mentioned above to reduce the knitting width stepwise.

In this inside narrowing method also, the double stitches produced by the loop transferring are formed in the state of being released from the needle and, as a result of this, only a single stitch loop is always retained by the hook. Since the knitting width can be narrowed without forming the double stitches on the hook, the knitting of a knitted fabric can be achieved very smoothly. Also, even when three stitch loops are retained by a single needle in the stitch-narrowing knitting, any of those stitch loops can be released from the needle by the method mentioned above to be laid over the stitch loop of the previous course and, thereby, the number of stitch loops retained by the needle can be reduced to improve the knitting condition.

Embodiment 4

Figure 11:
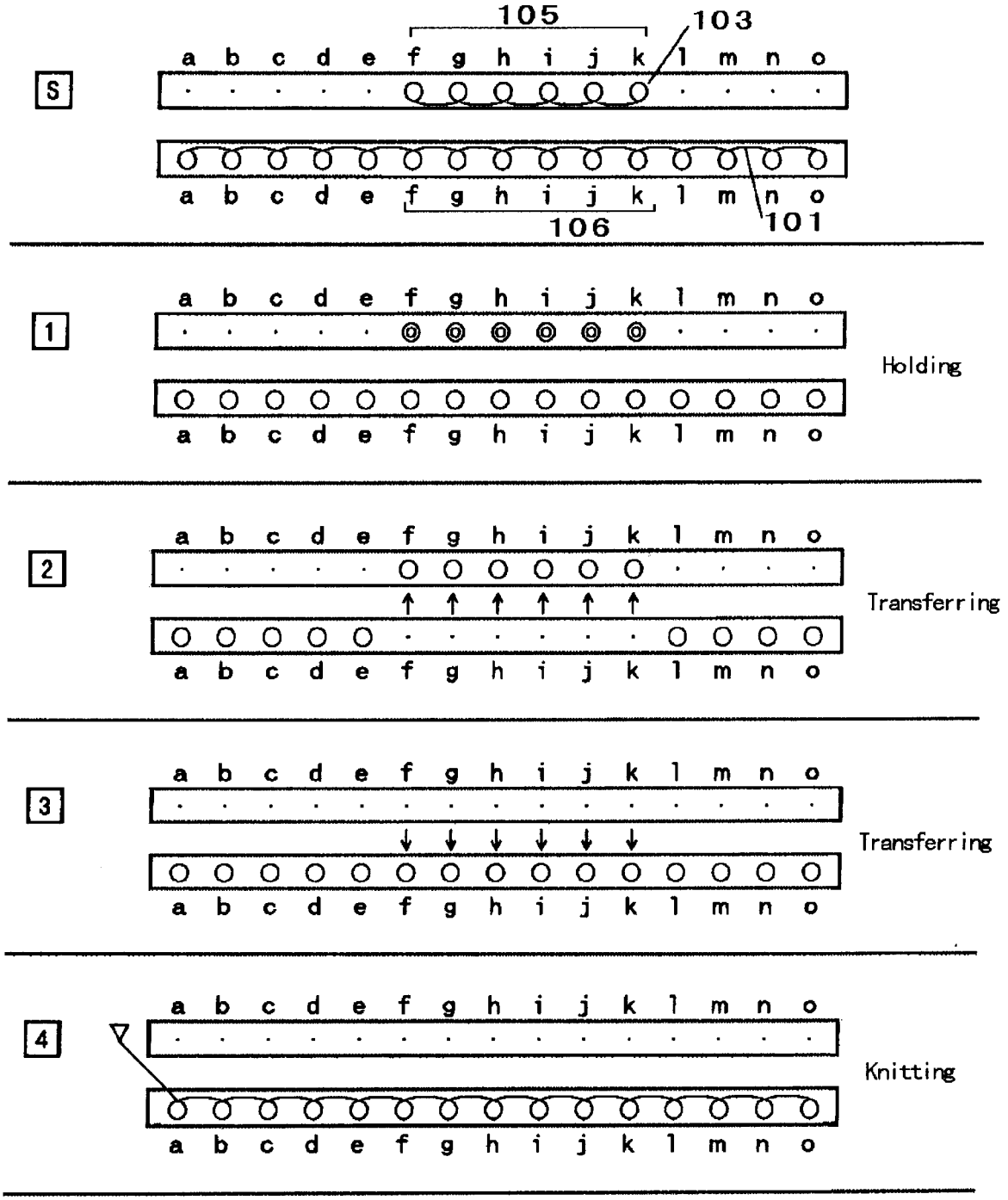
FIG. 11 shows diagrams showing knitting steps in the knitting in which knitted fabrics formed by the knitting of Embodiment 4 are joined together.

Next, an example of the stitch loop retaining method of the invention applied for the knitting to join the knitted fabrics together will be illustrated. In the following, an example of the so-called reverse knitting will be illustrated in which a front body is cast on from a shoulder portion thereof and knitted up at the hem thereof and a pocket portion of the fabric knitted during the reverse knitting is joined together with the front body. FIG. 11 shows the knitting steps therefor.

The step S shows the state of the stitch loops being retained by the needles on the respective beds. Stitch loops of a front body 101 are retained by the needles a–o on the front bed and a group of stitch loops 105 of a pocket portion 103 are retained by the needles f–k on the back bed. In the step 1, the group of stitch loops 105 of the pocket 103 retained by the needles on the back bed are held on the tongues of the sliders of the needles, respectively. In the next step 2, a group of stitch loops 106 of the front body 101 retained by the needles f–k on the front bed are transferred to the confronting needles f–k holding the group of stitch loops 105 of the pocket 103 on their slider tongues, so that the group of stitch loops 105 of the pocket 103 are retained on the group of stitch loops 106 of the front body 101 to form double stitches by the group of stitch loops of the previous course (not shown) of the front body 101 and the group of stitch loops 105 of the pocket 103. In the step 3, the group of stitch loops 106 of the front body 101 transferred to the needles f–k on the back bed are transferred back to the original needles f–k on the front bed. This enables the final course of the pocket 103 to be joined to the front body 101 without retaining the double stitches on the hooks of the needles. This knitting of the subsequent step 4 is repeated to knit the subsequent courses of the front body 101 after the pocket 103 and the front body 101 are joined together.

While the above-illustrated embodiments are discussed mainly on the method using the two-bed flat knitting machine having arrays of compound needles arranged on a pair of oppositely arranged front and back needle beds, the flat knitting machine used is not limited to the illustrated two-bed flat knitting machine. For example, a flat knitting machine including a transfer jack bed having transfer jacks arranged at the top of either or both of the two beds may be used to do the loop transferring through the transfer jacks. Alternatively, a four-bed flat knitting machine in which another pairs of compound needles are arranged at the top of each bed of the two-bed flat knitting machine may be used. Also, while in the illustrated embodiment 1, the two successive cam locks are used, as shown in FIG. 3, so that the holding of the stitch loop can be effected by the leading cam lock, while on the other hand, the loop transferring operation can be effected by the trailing cam, the cam lock system may be modified so that both of the holding of the stitch loop and the loop transferring can be effected in a single cam lock. Also, the needle proper and the slider of each of the compound needles may be each advanced and retracted by an actuator connected thereto such as a linear motor, instead of the cam mounted on the carriage. It is to be understood that the stitch loop retaining method of the invention is applicable to a variety of knitting and that various changes and modification may be made in the invention without departing from the sprit of the present invention.

As noted above, in the stitch loop retaining method of the invention, the double stitches, which are formed in the loop transferring performed in the knitting process such as the stitch-narrowing knitting process, are not formed on the needle until they are cleared from the needle. Thus, the double loops are not retained by the hook of the needle, thus enabling the advantageous effect that thread breakage and rigidity problem of the slider can be prevented when fine stitches of high stitch densities are formed by a fine gauge machine, for example.

What is claimed is:

1. A method of retaining a stitch loop using a flat knitting machine having (i) at least one first bed with a plurality of arrays of compound needles mounted thereon, each needle having a needle proper with a hook at a top end thereof and a slider having a tongue comprising two combined blades such that the needle proper and the slider are individually moveable forward and backward, and (ii) at least one second needle bed with a plurality of arrays of knitting members that transfer and receive stitch loops to and from the compound needles mounted thereon, wherein when a stitch loop (66, 86, 98, 106) retained by the knitting member on the second bed is transferred to the compound needle on the first bed retaining a stitch loop (65, 85, 97, 105), the stitch loop (65, 85, 97, 105) retained by the compound needle on the first bed is knocked over from the compound needle, to retain the stitch loop (65, 85, 97, 105) on the stitch loop (66, 86, 98, 106) transferred from the knitting member on the second bed to the compound needle on the first bed, the stitch loop retaining method comprising the steps of:

(a) resting the stitch loop (65, 85, 97, 105) on the tongue of the slider of the compound needle on the first bed;

(b) operating the knitting member on the second bed to guide the stitch loop (66, 86, 98, 106) retained by the knitting member to a transferring position where the stitch loop (66, 86, 98, 106) is transferred to the confronting compound needle on the first bed;

(c) maintaining the compound needle on the first bed in a state in which the stitch loop (65, 85, 97, 105) is rested on the tongue of its slider, and advancing the hook of the needle proper into the stitch loop (66, 86, 98, 106) retained on the knitting member on the second bed confronting the compound needle and positioned at the transferring position;

(d) retracting the knitting member on the second bed to allow the stitch loop (66, 86, 98, 106) retained thereon to be retained by the hook of the compound needle on the first bed; and (e) retracting the needle proper and the slider of the compound needle on the first bed so that the stitch loop (65, 85, 97, 105) rested on the tongue of the slider of the compound needle on the first bed is knocked over beyond an end of the tongue and the hook, wherein the stitch loop (65, 85, 97, 105) is retained on the stitch loop (66, 86, 98, 106) transferred to the compound needle on the first bed.

2. The stitch loop retaining method according to claim 1, wherein a flat knitting machine having the second bed of a plurality of arrays mounted thereon of compound needles similar to the compound needles arranged on the first bed is used.

3. The stitch loop retaining method according to claim 1, wherein a flat knitting machine having the second bed of a plurality of arrays of transfer jacks mounted thereon is used.

4. The stitch loop retaining method according to claim 1, wherein step (a) further comprises a step of retracting only the needle proper after the needle proper and the slider of the compound needle retaining the stitch loop by the hook are advanced so that the stitch loop retained by the hook can be rested on the tongue of the slider to allow the stitch loop to be rested on the tongue of the slider.

5. The stitch loop retaining method according to claim 2, wherein step (a) further comprises a step retracting only the needle proper after the needle proper and the slider of the compound needle retaining the stitch loop by the hook are advanced so that the stitch loop retained by the hook can be rested on the tongue of the slider to allow the stitch loop to be rested on the tongue of the slider.

6. The stitch loop retaining method according to claim 3, wherein step (a) further comprises a step of retracting only the needle proper after the needle proper and the slider of the compound needle retaining the stitch loop by the hook are advanced so that the stitch loop retained by the hook can be rested on the tongue of the slider to allow the stitch loop to be rested on the tongue of the slider.

7. The stitch loop retaining method according to claim 1, wherein step a further comprises additional steps of guiding the knitting member on the second bed retaining the stitch loop to a position to transfer the stitch loop; advancing the needle proper and the slider of the confronting compound needle on the first bed to allow the hook and the tongue to go into the loop of the stitch loop retained by the knitting member on the second bed; and retracting the knitting member of the second bed to allow the stitch loop to be rested on the tongue of the compound needle on the first bed.

8. The stitch loop retaining method according to claim 2, wherein step (a) further comprises additional steps of guiding the knitting member on the second bed retaining the stitch loop to a position to transfer the stitch loop; advancing the needle proper and the slider of the confronting compound needle on the first bed to allow the hook and the tongue to go into the loop of the stitch loop retained by the knitting member on the second bed; and retracting the knitting member of the second bed to allow the stitch loop to be rested on the tongue of the compound needle on the first bed.

9. The stitch loop retaining method according to claim 3, wherein step (a) further comprises additional steps of guiding the knitting member on the second bed retaining the stitch loop to a position to transfer the stitch loop; advancing the needle proper and the slider of the confronting compound needle on the first bed to allow the hook and the tongue to go into the loop of the stitch loop retained by the knitting member on the second bed; and retracting the knitting member of the second bed to allow the stitch loop to be rested on the tongue of the compound needle on the first bed.

* * * * *